US007422033B2

(12) United States Patent
Barber

(10) Patent No.: US 7,422,033 B2
(45) Date of Patent: Sep. 9, 2008

(54) POSITION FEEDBACK PILOT VALVE ACTUATOR FOR A SPOOL CONTROL VALVE

(75) Inventor: Dennis R. Barber, Oconomowoc, WI (US)

(73) Assignee: HUSCO International, Inc., Waukesha, WI (US)

( * ) Notice: Subject to any disclaimer, the term of this patent is extended or adjusted under 35 U.S.C. 154(b) by 0 days.

(21) Appl. No.: 11/013,667

(22) Filed: Dec. 16, 2004

(65) Prior Publication Data

US 2006/0130914 A1 Jun. 22, 2006

(51) Int. Cl.
*F15B 13/043* (2006.01)

(52) U.S. Cl. ..... 137/625.64; 137/625.68; 137/625.69; 251/30.04

(58) Field of Classification Search ..... 137/625.64, 137/625.69, 625.68, 625.66; 251/30.04
See application file for complete search history.

(56) References Cited

U.S. PATENT DOCUMENTS 3,434,390 A * 3/1969 Weiss ..... 91/51
3,653,409 A * 4/1972 Brannon ..... 137/625.63
4,011,891 A * 3/1977 Knutson et al. ..... 137/625.62
4,215,723 A * 8/1980 Ichiryu et al. ..... 137/625.63
4,290,447 A * 9/1981 Knutson ..... 137/596.2
4,428,400 A * 1/1984 Tantardini ..... 137/625.61
4,485,846 A * 12/1984 Neff ..... 137/625.64
4,569,273 A * 2/1986 Anderson et al. ..... 91/447
5,056,561 A * 10/1991 Byers ..... 137/625.64
5,138,838 A 8/1992 Crosser
5,350,152 A 9/1994 Hutchison et al.
5,366,202 A 11/1994 Lunzman
5,520,217 A * 5/1996 Grawunde ..... 137/625.63
5,568,759 A 10/1996 Aardema
5,664,477 A 9/1997 Koehler
5,896,890 A * 4/1999 Bourkel et al. ..... 137/625.63
5,921,279 A * 7/1999 Barber ..... 137/596.16
6,637,461 B2 * 10/2003 Post ..... 137/625.63

* cited by examiner

*Primary Examiner*—John Rivell
*Assistant Examiner*—Craig M Schneider
(74) *Attorney, Agent, or Firm*—Quarles & Brady; George E. Haas

(57) ABSTRACT

A spool type control valve is operated by an electrically driven pilot valve. A pilot piston is attached to the control spool. As an electrical actuator moves the pilot spool, a greater pressure is applied to one side of the pilot piston than the other side, which causes movement of the control spool. When the control spool reaches the desired position, its positional relationship to the pilot valve defines a pressure differential across the pilot piston which exerts a net force on the control spool that counterbalances a spring force acting on the control spool. This defines an equilibrium position at which the control spool remains until subsequent motion of the pilot spool occurs which alters the pressure differential across the pilot piston.

16 Claims, 6 Drawing Sheets

200
206
242
202
52
260
240
232
243
241
224
222
245
236
234
238
244
246
248
258
256
212
204
214
216
228
208
226
210
230
220
218
250
252
254

200
206
242
52
240
232
243
224
222
245
236
234
238
244
246
248
258
256
214
228
208
226
210
230
218
250
252

200
206
242
52
260
240
232
243
224
222
245
236
234
238
244
246
248
258
256
214
228
208
226
210
230
218

POSITION FEEDBACK PILOT VALVE ACTUATOR FOR A SPOOL CONTROL VALVE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to pilot operated hydraulic control valves; and more particularly to electrically operated pilot valves with a position feedback mechanism.

2. Description of the Related Art

Agricultural tractors and other types of hydraulically operated machinery commonly have components that are moved by a hydraulic cylinder/piston arrangement. The piston slides within the cylinder and divides the cylinder interior into two chambers. By selectively applying hydraulic fluid under pressure to one chamber and draining hydraulic fluid from the other chamber, the piston can be forced to move in opposite directions within the cylinder. Such movement drives a rod connected between the piston and a component of the machinery.

With reference to FIG. 1, a basic hydraulic system 10 for a machine comprises the cylinder 12 and piston 14 which is connected by a manually operated spool control valve 16 to a pair of return and supply lines 18 and 20. The supply line 20 receives pressurized fluid from a pump 22, while the return line 18 carries hydraulic fluid from the cylinder 12 back to a tank 24. The control valve 16 is a conventional manually operated, three-position, four-way spool valve with a pair of workports 15 to which the chambers of the cylinder 12 connect. The center, or neutral, position of the control valve disconnects the hydraulic cylinder 12 from both the return and supply return lines 18 and 20. In the other two positions of the control valve 16, the supply line 20 is coupled to one of the cylinder chambers 26 or 28 and the other chamber is connected to the tank 24 via the return line 18.

There is a present trend in agricultural equipment away from manual operation of the hydraulic valves toward electrically operated valves. This not only permits the valves to be located remotely from the operator position, but also enables computer control of the valves which allows more sophisticated functions to be provided. With electrical controls, the operator manipulates a joystick or other type of electrical input device to send signals to a microcomputer based controller, thereby indicating the desired movement of the associated components on the agricultural equipment. The controller interprets the electrical signals from the operator's input device and generates control signals which operate the hydraulic valves that control a hydraulic actuator which produces the desired motion.

In order to move a conventional spool valve in reciprocal directions, solenoid operators typically are attached to opposite ends of the spool. Each solenoid is energized independently to move the spool in the appropriate direction to a position where the proper fluid flow occurs to and from the hydraulic cylinder. Although there is a relationship between the magnitude of electrical current applied to a solenoid and the resultant position of spool, that relationship varies from valve to valve and also changes during the life of each valve due to a number of factors. Therefore, various types of position sensing devices have been attached to the spool valve provide an electrical feedback signal to the controller indicating the actual position of the spool. The controller compares the actual position to the desired position of the spool and adjusts the electric current applied to the solenoid coil to place the spool at the desired position. Although such position sensing feedback mechanisms operated satisfactorily, they required additional electrical components, thus adding to the expense and complexity of the solenoid operated spool valve.

In addition, there is a limit to the force and stroke that a solenoid actuator can apply to the spool control valve, which in turn limits the flow and pressure capability of the valve. To overcome these limitations, the spool control valve can be operated by a pilot valve which is directly controlled by the solenoid actuator. Although a pilot valve operator achieves higher flow and pressure capability from the main control valve, it too has drawbacks in performance, such as hysteresis, position resolution, and the ability to respond to small changes in the commanded position. These limitations result from the open loop nature of pilot operated valve control. Thus, a better control mechanisms are desired for electrically operated spool valves.

SUMMARY OF THE INVENTION

A valve assembly has a control spool which selectively controls flow of fluid between at least one workport and supply and return passages. The control spool is operated by a pilot valve that comprises piston bore formed in a body of the valve assembly and into which a section of the control spool extends. A pilot piston is connected to the control spool and is slideably received in the piston bore, thereby defining a first chamber and a second chamber in the piston bore on opposite sides of the pilot piston. A pilot spool is slidably received in the body and is moveable with respect to the control spool to open and close fluid paths between the first chamber and both the supply passage and a return passage, and between the second chamber and both the supply passage and a return passage. A linear actuator, such as a solenoid or a stepper motor, for example, is operably coupled to move the pilot spool with respect to the control spool.

In a preferred embodiment of this valve assembly, the piston bore is aligned with or a section of the bore for the control spool. The piston bore has a first opening which communicates with one of the supply passage and the return passage, and has a second opening communicating with the other of the supply passage and the return passage. The control spool extends through a tubular pilot piston and is connected thereto. A feeder aperture in the pilot piston communicates with the first opening in the body and with a first aperture in the control spool.

A pilot spool is slidably received within a pilot bore in the control spool with the first aperture opening into the pilot bore. The pilot spool has a first position which opens a first passage between the first aperture and the first chamber in the piston bore and opens a second passage between the first aperture and the second chamber in the piston bore. In a second position, the pilot spool opens the first passage and a third passage between the second chamber and the second opening in the piston bore. In a third position, the pilot spool opens the second passage and a fourth passage between the first chamber and the second opening. A linear actuator is operably coupled to move the pilot spool within the control spool.

In another embodiment, the valve assembly body has a piston bore and a separate pilot valve bore that opens into the piston bore. A pilot piston is coupled to the control spool and is slideably received in the piston bore thereby defining the first and second chambers in the piston bore. The pilot piston has a surface with a predefined contour, such as a linear taper, for example. The body further includes a first pilot passage extending from the first chamber to the pilot valve bore, and a second pilot passage that extends from the second chamber to the pilot valve bore. The supply passage also opens into the pilot valve bore.

A tubular pilot sleeve is slidably received in the pilot valve bore and has an outer surface and an inner surface that defines a pilot spool bore. A plurality of transverse passages extend between the inner and outer surfaces and communicate with the supply passage, the first pilot passage and the second pilot passage. The tubular pilot sleeve engages the surface of the pilot piston wherein movement of the pilot piston produces movement of the tubular pilot sleeve. A pilot spool is movable within the tubular pilot sleeve into a plurality of positions which provide fluid paths between selected combinations of the plurality of transverse passages. A linear actuator is coupled to the pilot spool for moving the pilot spool within the tubular pilot sleeve.

Movement of the pilot spool by the linear actuator opens paths for fluid to and from the chambers on opposites sides of the pilot piston, thereby moving the control spool. As the pilot piston moves, the pilot sleeve rides along the contoured pilot piston surface which produces movement of the pilot sleeve within the pilot bore. This provides a feedback indication of the location of the control spool. When the control spool is in the desired location, the pilot sleeve has moved to a position at which the chambers on the opposite sides of the pilot piston are closed off from the supply passage. This terminates further movement of the pilot piston and the control spool until the linear actuator changes the position of the pilot spool.

DETAILED DESCRIPTION OF THE INVENTION

Figure 1:
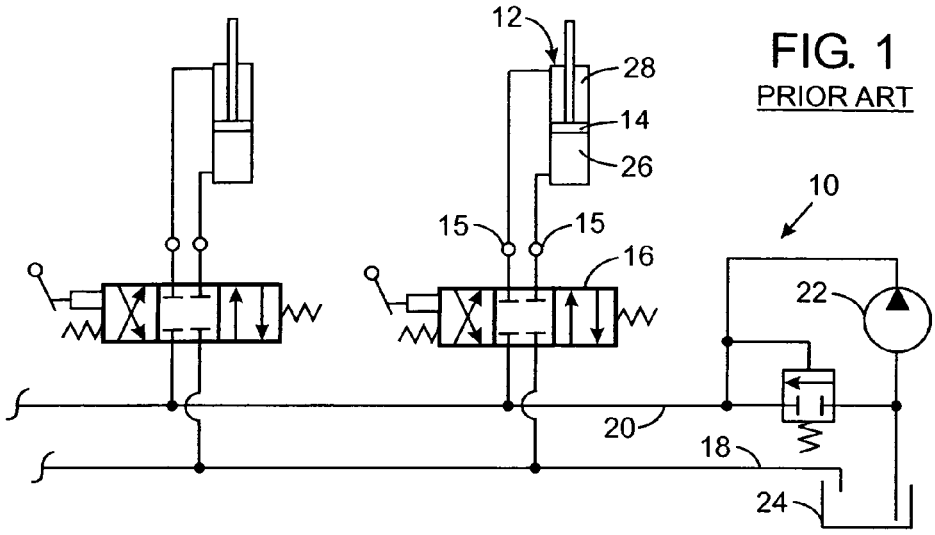
FIG. 1 PRIOR ART
FIG. 1 represents a basic hydraulic system according to the prior art.
Figure 2:
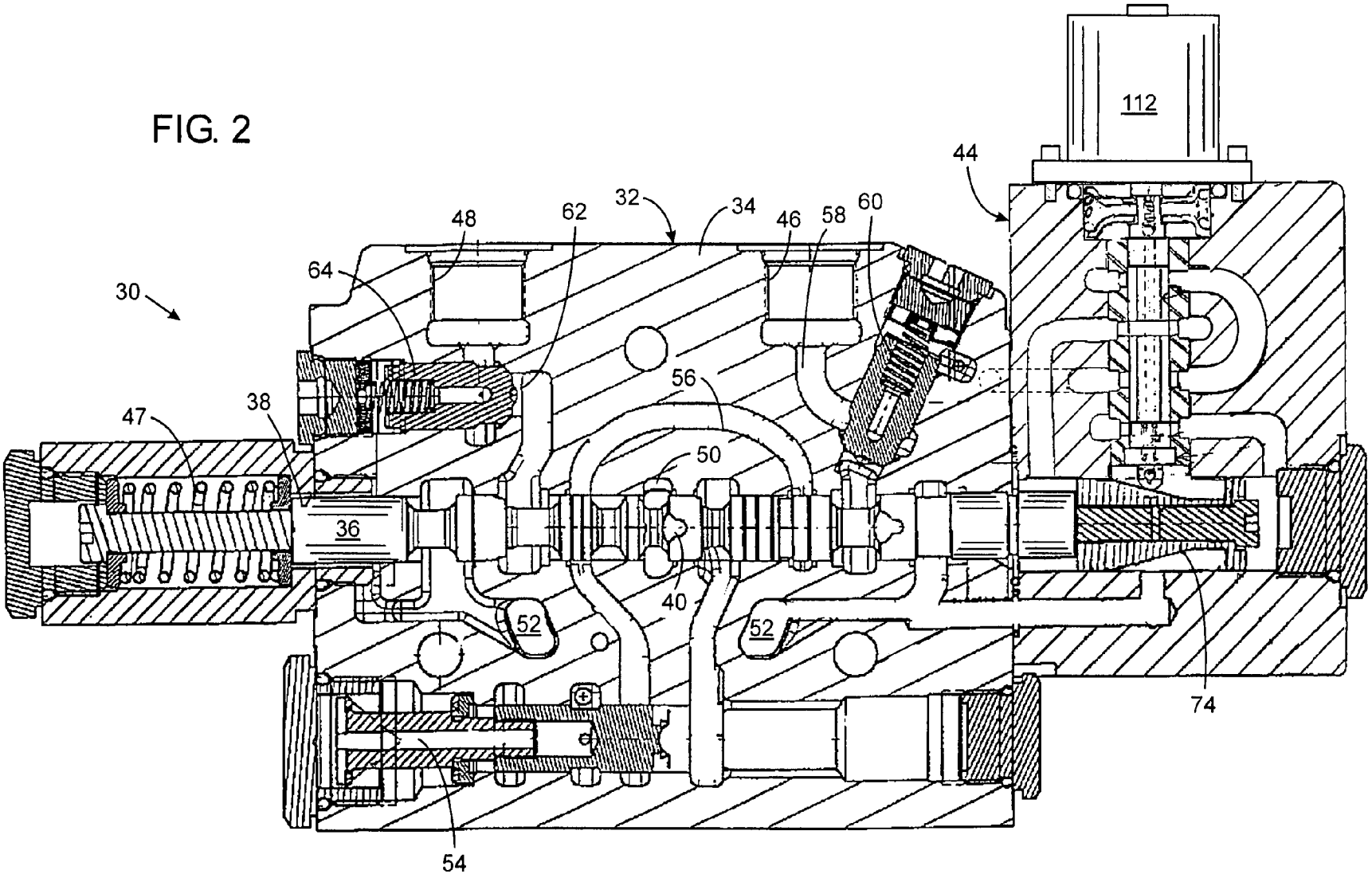
FIG. 2 is a cross section view through a valve assembly with a control spool operated by a pilot valve that has a spool position feedback mechanism according to the present invention.

The conventional manually operated spool valve 16 in FIG. 1 can be replaced with the electrically operated valve assembly 30, illustrated in FIG. 2. Several such valve assemblies 30, one for each hydraulic cylinder, can be mounted side by side to form a valve construction for the hydraulic system of the machine.

The valve assembly 30 has a housing 32 with a main valve housing 34 with a supply passage 50 connected to the supply line 20 from the pump 22 and a set of tank passages 52 connected to the return line 18. The supply and tanks passages 50 and 52 extend into the plane of the drawing from one valve assembly to the next one. A control spool 36 is received in a bore 38 in the main valve housing 34 and is illustrated in a neutral, center position in which fluid does not flow through the valve. A spring arrangement 47 is connected to one end of the control spool 36 and biases the control spool into the neutral, center position.

The control spool 36 moves in reciprocal directions within the bore 38 by operation of an pilot valve 44 attached to the opposite end of the control spool from the spring arrangement 47. Depending on which direction the control spool 36 moves, paths are created which direct pressurized hydraulic fluid through one of the workports 46 or 48 to the lower or upper chamber 26 or 28 of the cylinder 12, thereby driving the piston 14 up or down, respectively (FIG. 1). The position of the control spool 36 within the bore 38 determines amount of that fluid flow and thus the speed of the cylinder piston 14. References herein to directional relationships and movement, such as upper and lower or left and right, refer to the relationship and movement of the valve components in the orientation illustrated in the drawings, which may not be the orientation of the components as attached to machinery.

To raise the piston 14, the machine operator moves the control spool 36 rightward from the illustrated center position. This opens a path which allows fluid from the supply passage 50 to flow through a metering orifice formed by a set of notches 40 in the control spool 36 and through a conventional pressure compensator 54 into a bridge passage 56. The hydraulic fluid continues to travel from the bridge passage 56 to a first workport passage 58, past a first pressure relief valve 60, and out the first workport 46 to the lower chamber 26 of the cylinder 12.

The pressure thus applied to the lower cylinder chamber 26 causes the piston 14 to move up, which forces hydraulic fluid out of the upper cylinder chamber 28. This exhausting fluid flows into the second workport 48, past a second pressure relief valve 64, and through the second workport passage 62 into the spool bore 38. The present position of the control spool 36 creates a path between the second workport passage 62 and one of the tank passages 52 in the main valve housing 34.

To lower the piston 14, the control spool 36 is moved to the left, which opens a corresponding set of paths so that fluid from the supply passage 50 travels via the bridge passage 56 and the second workport passage 62 to the second workport 48. The new spool position forms another path through which fluid exhausted from the lower cylinder chamber 26 flows through the first workport 46 to the other tank passage 52 in the main valve housing 34.

The control spool 36 is moved in response to forces applied by the pilot valve 44 which has a pilot housing 70 that is attached to the main valve housing 34 by a suitable means, such as machine screws (not shown). Alternatively the pilot housing 70 and the main valve housing 34 may be formed by single metal casting for the body 32. The pilot housing 70 has a piston bore 72 which is aligned with the spool bore 38 in the main valve housing 34. A pilot piston 74 is attached to the end of the control spool 36 that protrudes from the valve housing 34 into the piston bore 72. The pilot piston 74 is fixedly attached to the control spool 36 by a nut 77 (as illustrated), a machine screw, or other suitable mechanism. Therefore, the pilot piston 74 and the control spool 36 slide within the bores 38 and 72 as an integral assembly. Alternatively, the pilot piston 74 and the control spool 36 could be fabricated from a single piece of material.

A first pilot chamber 76 is created in the piston bore 72 between the pilot piston 74 and a land of the control spool 36 and a second pilot chamber 78 is formed between the pilot piston 74 and a plug 80 which closes the open end of the piston bore. The pilot piston 74 has an annular recess 82 with a tapered surface 84 which defines an intermediate pilot chamber 86 between the first and second pilot chambers 76 and 78 and isolated there from by elements of the pilot piston 74. A branch of the tank passage 52 communicates with the intermediate pilot chamber 86.

A pilot valve bore 90 opens into the intermediate pilot chamber 86 and extends orthogonally from the piston bore 72 to a surface of the pilot housing 70. A first pilot passage 92 extends from the first pilot chamber 76 to approximately the mid-point along the length of the pilot valve bore 90. A second pilot passage 94 extends from the second pilot chamber 78 to a location in the pilot valve bore 90 between the opening of the first pilot passage 92 and the piston bore. A branch of the supply passage 50 extends into the pilot housing 70 and opens into the pilot valve bore 90 between the first and second pilot passages 92 and 94. A pilot bridge passage 96 extends between the opening of the supply passage 50 into the pilot valve bore 90 and another point along the pilot valve bore on a remote side of the first pilot passage 92.

A tubular pilot sleeve 98 is slidably received within the pilot valve bore 90 and has a projection 99 which extends into the piston bore 72 and engages the surface of the piston recess 82. The opposite end of the pilot sleeve 98 is biased toward the pilot piston 74 by a first spring 107. The tubular pilot sleeve 98 having a pilot spool bore 95. The pilot sleeve 98 has four sets of transverse passages 101, 102, 103, and 104 extending between its inner and outer diametric surfaces. As the pilot sleeve 98 slides within the pilot valve bore 90, each of these transverse passages 101-104 continues to communicate with one of the passages 94, 50, 92, and 96, respectively, in the pilot housing 70.

A pilot spool 100 is slidably received within the central opening of the pilot sleeve 98, and is biased toward the end of the sleeve with the projection 99 by a second spring 109. The upper end of the pilot spool 100 has a head 108 which engages a slot in a shaft 110 of a stepper motor 112. Rotation of the stepper motor 112 causes the shaft 110 to move linearly into and out of the motor housing, thereby moving the pilot spool 100 up and down within the pilot sleeve 98. As will be described, movement between the pilot spool 100 and the pilot sleeve 98 opens and closes the transverse passages 101-104 in the pilot sleeve. Specifically, notches 105 and 106 in the pilot spool 100 provide passages between those apertures. Although the present invention is being described in the context of a stepper motor 112, which produces linear motion of the pilot spool 100, other types of linear actuators, such as a solenoid coil, can be employed in place of the stepper motor. However, a stepper motor is preferred as providing greater resolution of motion.

Figure 4:
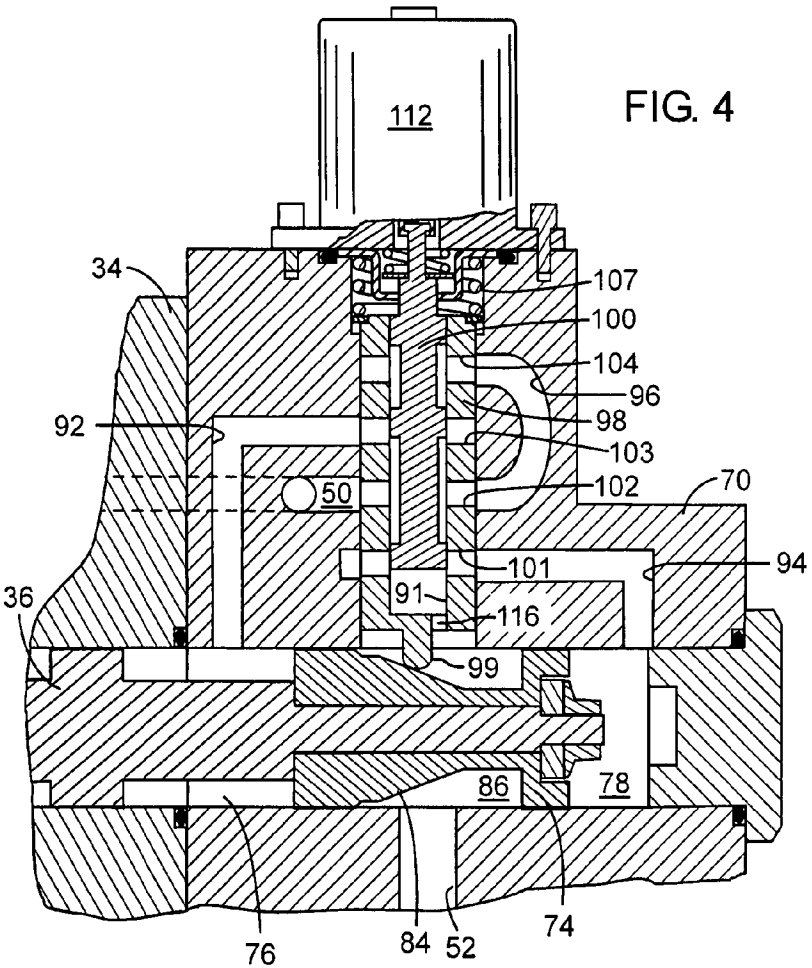

In order to move the control spool 36 to the right in the drawings, the stepper motor 112 is activated to turn its shaft 110 in a direction in which moves the pilot spool 100 upward into a position such as the one depicted in FIG. 4. In this orientation, a path is created along the pilot spool 100 between the second and the third transverse passages 102 and 103 of the sleeve 98. These transverse passages 102 and 103 are aligned with the supply passage and the first pilot passage 92 in the pilot housing 70. This alignment communicates pressurized fluid from the supply passage 50 to the first pilot chamber 76. At the same time, the position of the pilot spool 100 provides another path between the first transverse passage 101 and the interior bore 91 of the pilot sleeve 98. The first transverse passage 101 is aligned with the second pilot passage 94 in the pilot housing 70. This allows fluid to flow from the second pilot chamber 78 into that interior bore 91 and through an end aperture 116 into the intermediate pilot chamber 86 from which the fluid continues to flow into the tank passage 52. This relieves pressure within the second pilot chamber 78. As a consequence, the pressurized fluid being introduced into the first pilot chamber 76 drives the pilot piston 74 and the attached control spool 36 to the right in the drawings, thereby enabling fluid to flow to and from the two workports 46 and 48, as previously described with respect to FIG. 2.

Figure 5:
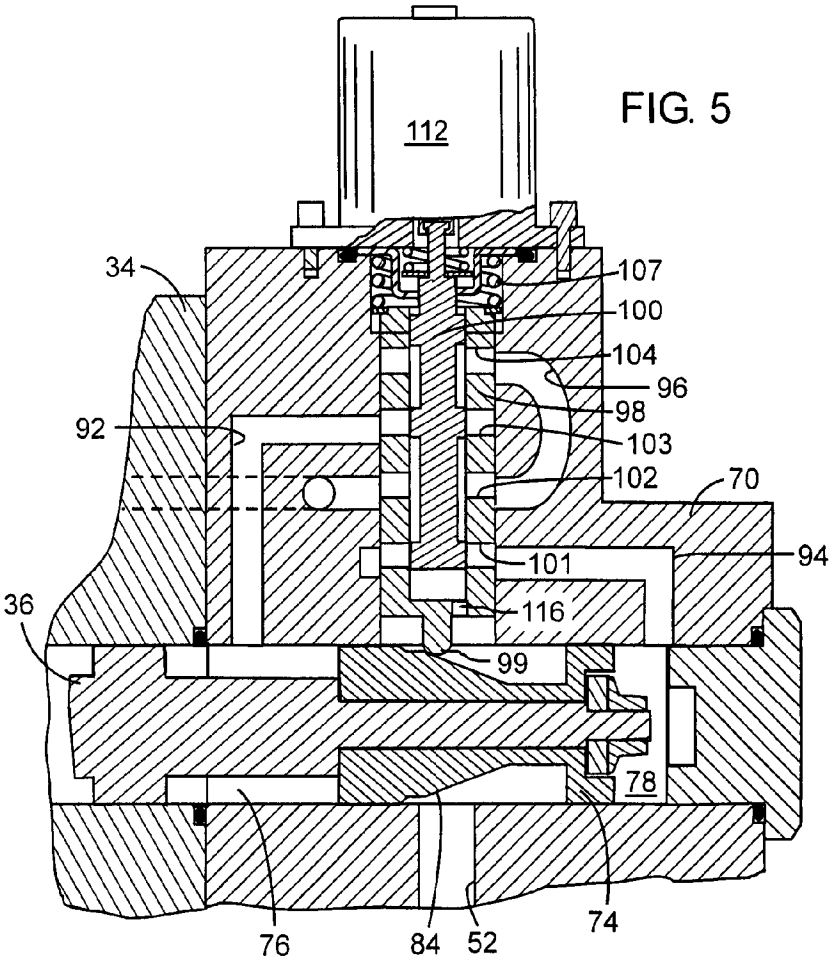
FIGS. 4 and 5 depict the pilot valve in two stages of moving the control spool in one direction from center.

As the pilot piston 74 moves to the left, the projection 99 of the pilot sleeve 98 rides up on the tapered surface 84 of the pilot piston 74. This pushes the pilot sleeve 98 upward within the pilot valve bore 90 against the force of first spring 107 and into a position illustrated in FIG. 5. When the pilot piston 74 and the attached control spool 36 have moved into the desired position defined by the magnitude of current applied to the stepper motor 112, the pilot sleeve 98 has moved into a position at which the transverse passages 101 and 103 are closed due to alignment with lands on the pilot spool 100. This orientation, blocks fluid flow to and from the two pilot chambers 76 and 78, thus terminating further movement of the pilot piston 74.

It should be understood that the degree to which the pilot sleeve 98 moves within the pilot housing 70 due to engagement with the tapered surface on the pilot piston 74, corresponds to the degree to which the pilot spool 100 has been moved by the stepper motor 112. This related motion of the pilot sleeve 98 provides a position feedback mechanism which terminated the fluid flow when the pilot piston 74 and the control spool 36 are properly positioned.

Thereafter should other forces produce movement of the control spool 36 and pilot piston 74, the engagement of the pilot sleeve projection 99 with the piston's tapered surface 84 will produce a corresponding movement of the pilot sleeve. This motion of the pilot sleeve reopens the two pilot passages 92 and 94 applying further pressurized fluid to the piston chambers 76 and 78 and returning the control spool to the desired position.

Figure 3:
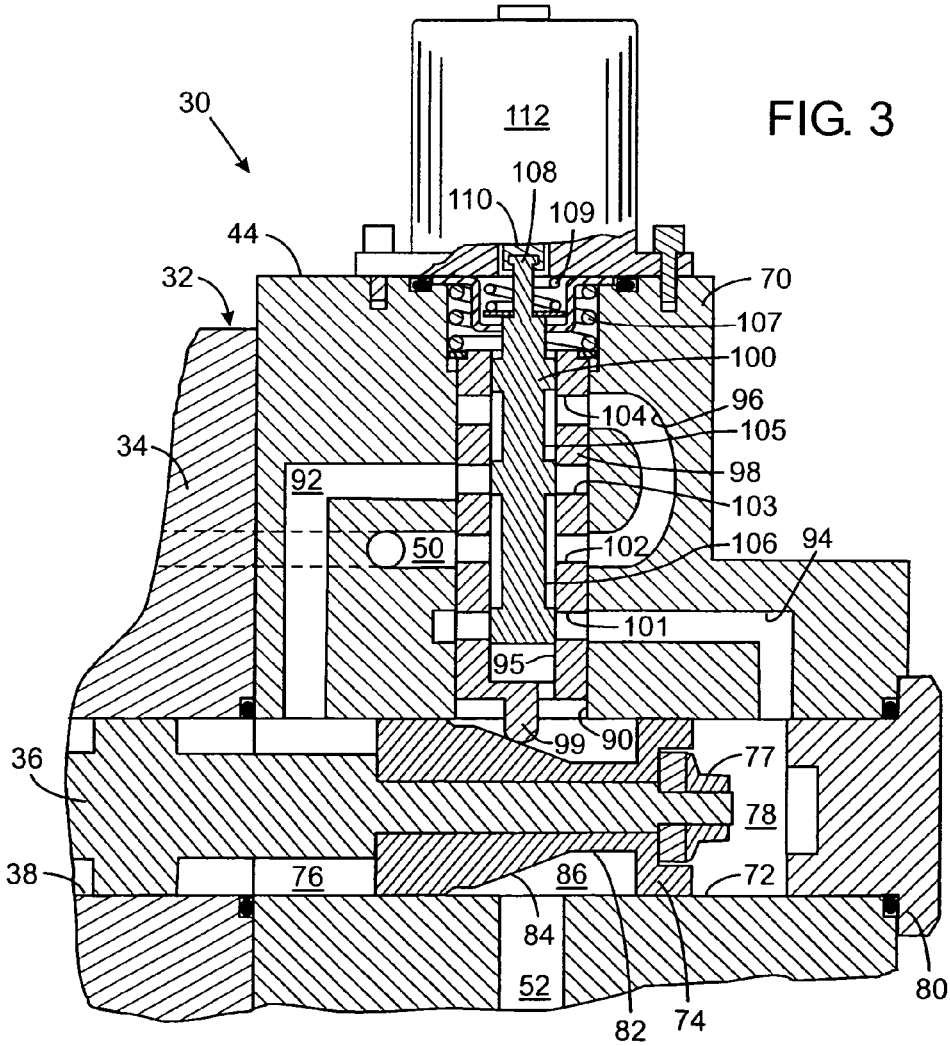
FIG. 3 is an enlarged cross section of the pilot valve when the control spool is centered.
Figure 6:
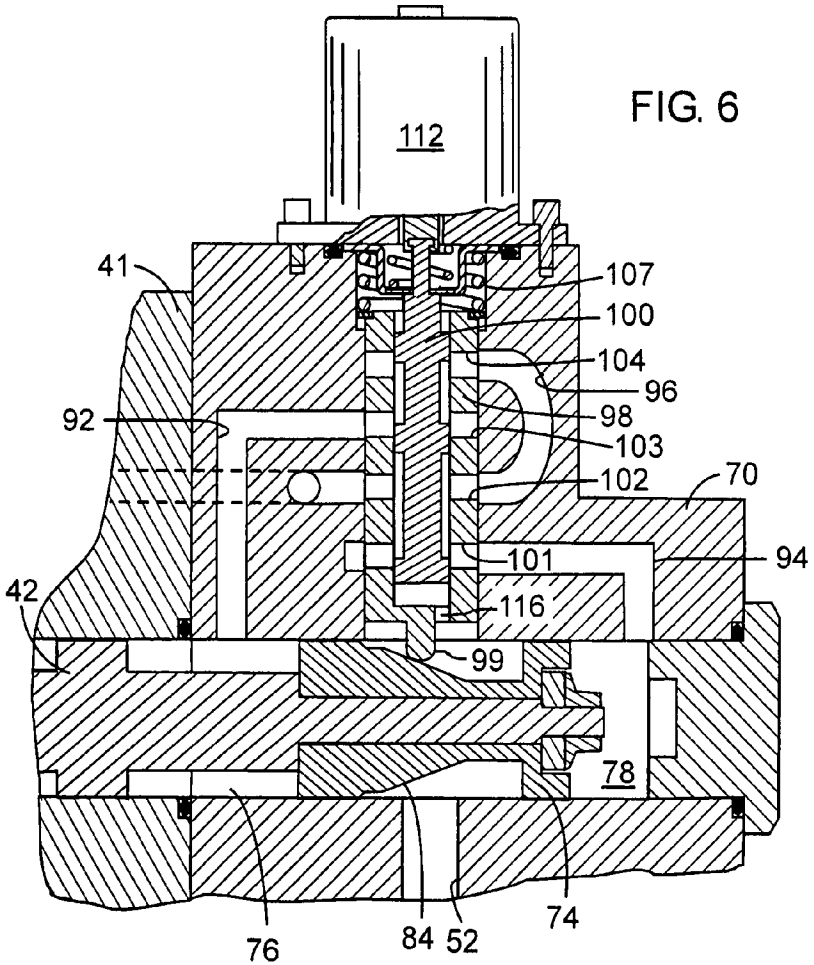

When it is desired to move the pilot piston 74 and the control spool 36 to the left, from the centered position illustrated in FIG. 3, the stepper motor 112 is operated to move the pilot spool 100 downward within the pilot sleeve 98. This aligns the pilot spool and sleeve, as shown in FIG. 6, in which a path is created through the pilot sleeve 98 between the supply passage 50 and the second pilot passage 94. This path applies pressurized fluid from the supply passage 50 to the second pilot chamber 78. Fluid from the supply passage 50 also flows through the pilot sleeve 98, through the pilot bridge passage 96 and into the fourth transverse passage 104 of the pilot sleeve. From there, the fluid continues to flow around the pilot piston 100 to the third transverse passage 103 and into the first pilot passage 92 in the pilot housing 70. This enables pressurized fluid from the supply passage 50 to enter the first pilot chamber 76. Note that any pressure at the lower end of the pilot spool bore 95 in the sleeve 98 flows through the intermediate pilot chamber 86 into the tank passages 52, thereby relieving any pressure in those areas of the pilot valve assembly.

The present orientation of the pilot spool 100 applies pressurized fluid from supply line 50 to both the first and second pilot chambers 76 and 78 on opposite sides of the pilot piston 74. Note that the pressure within the pilot chamber 76 acts on a relatively small surface area of the pilot piston 74 as compared to the combined surface area of the piston in the second pilot chamber 78. Due to this surface area difference, the pressurized fluid in the second pilot chamber 78 forces the pilot piston 74 and the attached control spool 36 to the left in FIG. 6. This motion opens communication within the main valve housing 34 between the workports 46 and 48 and the supply passage and tank passages 52.

Figure 7:
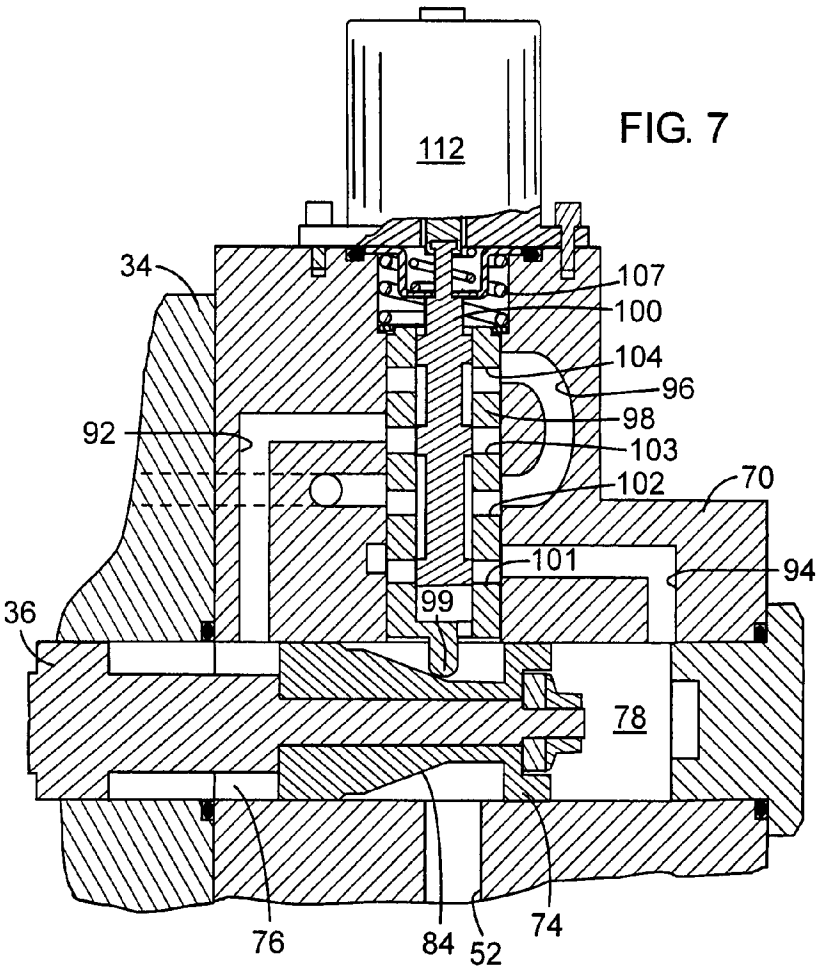
FIGS. 6 and 7 depict the pilot valve in two stages of moving the control spool in the opposite direction from center.

As the pilot piston 74 moves to the left, the projection 99 of the pilot sleeve 98 moves downward along the tapered surface 84 of the piston due to the biasing action of spring 107, as shown in FIG. 7. When the pilot piston 74 and control spool 36 reach the desired position, the pilot sleeve 98 has moved into a position in which the first and third transverse passages 101 and 103 in the pilot sleeve 98 are closed by lands on the pilot spool 100. This position terminates further application of pressurized fluid to the first and second pilot chambers 76 and 78, thereby maintaining the pilot piston 74 and the control spool 36 in the present position.

From this position, movement of the pilot spool 100 by the stepper motor 112 will again open up communication between various transverse passages 101-104 in the pilot sleeve 98 depending upon the direction of that pilot spool motion. That action applies pressurized fluid to one or both of the piston chambers 76 and 78, as described previously moving the pilot piston 74 into a new desired position.

Figure 8:
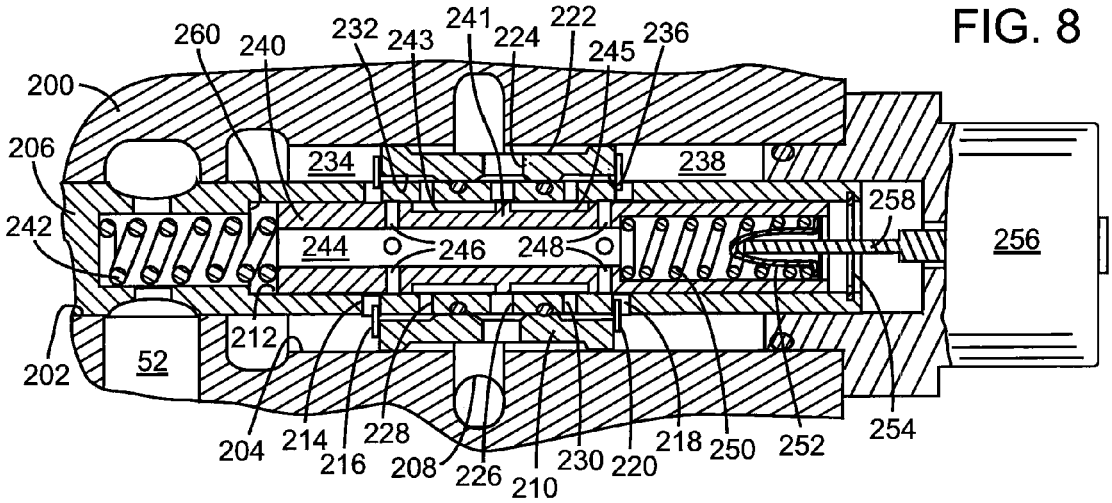
FIG. 8 is a partial cross section view through a second valve assembly according to the present invention in which the with a pilot valve is in-line with the control spool, the components are in a centered position.
Figure 9:
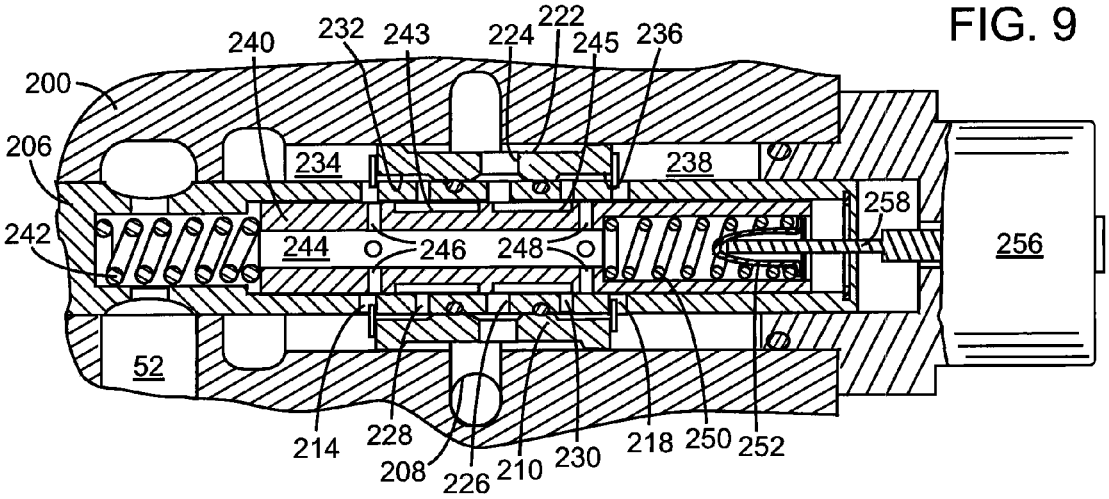
FIGS. 9 and 10 depict the pilot valve in two stages of moving the control spool in one direction from center.
Figure 10:
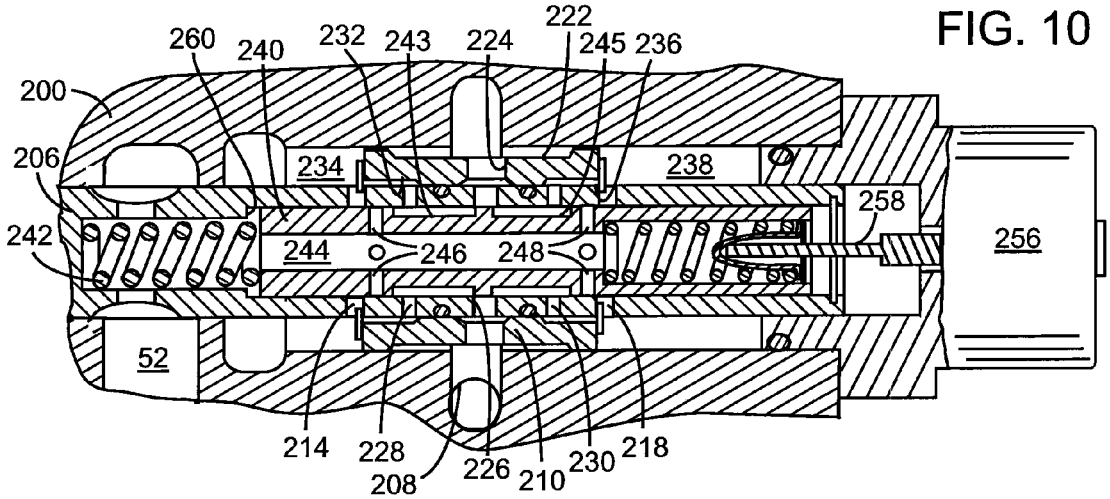

FIGS. 8-10 illustrate a preferred embodiment of the present position feedback pilot valve actuator for a spool control valve. This embodiment differs from the one in FIGS. 2-7 in that the pilot spool and linear actuator are in-line with the control spool instead of being orthogonally oriented. This latter embodiment has a valve body 200 that is similar to the main valve housing 34 in FIG. 2 with the exception that spool 36 is replaced by spool 206 and the pilot valve 44 is replaced by an in-line pilot valve assembly illustrated in FIG. 8.

With reference to FIG. 8, the spool bore 202 opens into a larger diameter coaxial piston bore 204. The piston bore 204 extends from the spool bore to an opening in a surface of the body 200. A branch 208 of the supply passage 50 for the valve assembly opens into the central portion of the piston bore 204 and one of the tank passages 52 has an opening into the piston bore 204. The control spool 206 projects from the spool bore 202 into the piston bore 204. In an alternative configuration, the piston bore 204 could be a similar sized section of the spool bore 202, in which case the outer diameter of the control spool is reduced in the piston bore section.

The section of the control spool 206 within the piston bore 204 extends through a tubular pilot piston, thereby defining first and second chambers 234 and 238 in the piston bore 204. Engagement of the pilot piston with the outer circumferential surface of the control spool 206 and the surface of the piston bore 204 provides fluid separation between the first and second chambers 234 and 238. The outer circumferential surface of the pilot piston 210 has a wide, centrally located, annular groove to 222 from which several feeder apertures 224 extend to an interior circumferential surface which abuts the control spool 206. Annular first and second interior grooves 232 and 236 are formed in the inner diametric surface of the pilot piston 210 at opposite ends.

A first set of cross apertures 214 is spaced radially around the control spool 206 to provide fluid paths between the outer circumferential surface and a pilot valve bore 212 in the control spool. An annular notch extends around the outer circumferential surface through the openings of the first set of cross apertures 214 and a first snap ring 216 is located within that annular notch. A similar second set of cross apertures 218 is located through the control spool 206 at the opposite end of the pilot piston 210 and a second snap ring 220 fits within another external groove running through the openings of those cross apertures. The two snap rings 216 and 220 fix the location of the pilot piston 210 around the control spool 206 and transfer force there between.

First radial apertures 226 are spaced radially around the control spool 206 and open into an annular notch in the interior surface of the pilot piston which connects the feeder apertures 224, thereby providing passages into the pilot valve bore 212. Second radial apertures 228 through the control spool 206 are on one side of the first radial apertures 226 and third radial apertures 230 in the control spool 206 are on the opposite side of the first radial apertures 226. The first interior groove 232 at one end of the pilot piston 210 provides a passage between the second radial apertures 228 and the first chamber 234 in the piston bore 204 to one side of the pilot piston 210. The second interior groove 236 of the pilot piston 210 provides a passage between the third transverse passages 230 in the control spool 206 and the second chamber 238 on the other side of the pilot piston 210 in the piston bore 204.

A pilot spool 240 is slidably received in the pilot valve bore 212 at the end of the control spool 206. A bias spring 242 located at the bottom of that pilot valve bore 212 and engages the interior end of the pilot spool 240 tending to force the pilot spool out of the bore. The pilot spool 240 has a primary aperture 244 longitudinally there through. A first set of exhaust apertures 246 extend radially outward from the primary aperture 244 to the exterior surface of the pilot spool 240. The first set of exhaust apertures 246 opens through the exterior surface of the pilot spool at a location that is between the cross apertures 214 and the second radial apertures 228 in the control spool 206, when the control spool is centered in the neutral position in FIG. 8. A second set of exhaust apertures 248 extends radially between the primary aperture 244 and the exterior surface of the pilot spool 240 with outer openings located between the second set of cross apertures 218 and the third transverse passages 230 of the control spool in the centered, neutral position. As will be described, the relationship between the sets of apertures 246 and 248 in the pilot spool with respect to the apertures in the control spool 206 changes in response to motion between those components. The pilot spool 240 also has annular first and second exterior grooves 243 and 245 that are separated by a land 241.

An overload spring 250 is located within an enlarged portion of the primary aperture 244 through the pilot spool 240 at an end which faces outward from the valve body 200. One end of the overload spring 250 abuts an interior shoulder of the primary aperture 244 and a cup-shaped spring guide 252 is received within the opposite end of the overload spring. A retaining clip 254 fits within an annular notch in the pilot valve bore 212 of the control spool 206 to retain the pilot spool 240 therein.

A stepper motor 256 serves as a bidirectional linear actuator which, when electrically driven, advances or retracts an output shaft 258 into or out of the pilot valve bore 212. The remote end of the stepper motor shaft 258 seats within the bottom of the spring guide 252. The stepper motor 256 is secured in the open end of the piston bore 204.

With continuing reference to FIG. 8, the control spool 206 is normally positioned in the illustrated centered, neutral position at which fluid is unable flow to or from the two workports. This positioning of the control spool 206 is accomplished by placing the stepper motor 256 at approximately its mid-travel position, which enables the spool return spring 47 to center the control spool. In this orientation, pressurized fluid from the supply line branch 208 flows through the feeder apertures 224 in pilot piston 210 and the first radial apertures 226 in the control spool 206 into both the exterior annular grooves 243 and 245 around the pilot spool 240. From those exterior grooves 243 and 245, the fluid continues through the second and third radial apertures 228 and 230 in the control spool 206 and the interior grooves 232 and 236 of the pilot piston 210 flowing ultimately into the first and second chambers 234 and 238 on opposite sides of that pilot piston. Thus in the centered, neutral position of the control spool 206, the pressures on both sides of the pilot piston 210 are equal, thereby maintaining the position of the pilot piston and the attached control spool.

When it is desired to move the control spool 206 to the left in the drawings, the controller for the hydraulic system applies a drive signal to the stepper motor 256 which produces an extension of the shaft 258 into the valve body 200. This motion of the motor shaft 258 does not compress the overload spring 250 which transmits the force of the motion to the pilot spool 240. As a result, the pilot spool moves to the left in the drawing, compressing the bias spring 242. As shown in FIG. 9, the pilot spool 240 moves into a position where the first radial apertures 226 in the control spool open only into the second annular groove 245 around the pilot spool. Thus, pressurized fluid from the supply line branch 208 is applied via that groove, the third transverse passages 230 in the pilot spool, and the interior groove 236 of the pilot piston into the second bore chamber 238. The new position of the pilot spool 240 is such that its first set of exhaust apertures 246 open into the second apertures 214 in the control spool. This creates a passage from the first chamber 234 through the pilot spool 240 into the cavity in which the bias spring 242 is located and onward to the return passage 52 in the valve body 200. This fluid passage relieves any pressure within the first chamber 234 establishing a pressure differential across the pilot piston 210. The greater pressure in the second chamber 238 forces the piston 210 and the attached control spool 206 to the left in the drawings into the desired position dictated by the linear motion of the stepper motor shaft and the pilot spool.

Eventually, the control spool 206 and the attached pilot piston 210 move into a position similar to that illustrated in FIG. 10. At this position, the first chamber 234 still is communicating with the tank passage 52 and the second chamber 238 is in communication with the supply passage branch 208. However, the size of the opening between the second groove 245 around the pilot spool 240 and the first radial apertures 226 in the control spool 206, through which pressurized fluid flows, now is reduced so that the pressure in the second chamber 238 is counterbalanced by the force from the spring 47 at the opposite end of the control spool (see FIG. 2). In this state of the valve assembly, an equilibrium exists between the force due to the fluid pressure and the force of the control spool spring and movement of the components stops. Note that the equilibrium position of the control spool is determined by the relative position of the pilot spool 240 as governed by the linear actuator, stepper motor 256.

The spring force of the overload spring 250 is such that it is not compressed during normal operation of the valve assembly. However, if the stepper motor 256 is operated very rapidly, the pilot spool may be driven against the inner shoulder 260 of the pilot valve bore 212 before the pressure differential is established across piston 210. At that time, further motion of the stepper motor 256 can not produce additional movement of the pilot spool and the shaft 258 will slip within the stepper motor. Such slippage alters the relationship between the rotational position of the stepper motor and the linear position of the shaft, which is undesirable. The overload spring 250 prevents slippage by compressing under the exertion of additional force by the stepper motor 256 when the pilot spool is bottomed against the inner shoulder 260 of the pilot valve bore 212.

To return the control spool 206 to the center, neutral position, the stepper motor 256 is energized to partially retract the shaft 258 to the right. The bias spring 242 exerts force which causes the pilot spool 240 to follow the retraction of the stepper motor shaft 258, thereby moving to the right in the drawings. This new orientation of the pilot spool 240 within the pilot valve bore 212 at the end of the control spool 206, opens up passages so that pressurized fluid from the supply line branch 208 is fed into the first chamber 234 and fluid in the second chamber 238 is exhausted to the tank passage 52. Specifically, the new position of the pilot spool 240 enables the pressurized fluid flowing through the first radial apertures 226 in the spool to continue into only the first exterior groove 243 around the pilot spool and through the second transverse passages 228 and first piston interior groove 232 to the first chamber 234. Another passage is created by communication of the second set of exhaust apertures 248 in the pilot spool 240 with the set of cross apertures 218 in the control spool 206. This orientation of apertures allows fluid to flow from the second chamber 238 through the primary pilot spool aperture 244 and the cavity of the bias spring 242 into the tank line 52. These passages apply a greater pressure to the first chamber 234 than in the second chamber 238, thereby exerting a net force which drives the pilot piston 210 and the attached control spool 206 to the right. Eventually, the pilot piston and control spool reach the orientation depicted in FIG. 8, in which fluid from supply passage branch 208 enters both pilot spool exterior grooves 243 and 245 thereby applying equal pressure is applied to the first and second chambers 234 and 238, which stops further motion.

Figure 11:
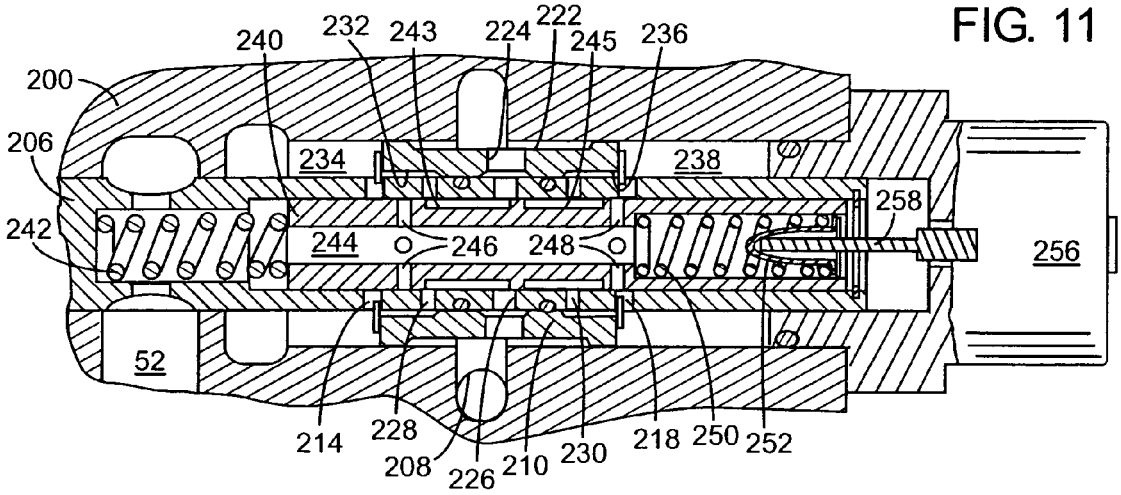
FIG. 11 depicts the pilot valve moved in the opposite direction from center.

As will be readily appreciated by one skilled in the art, retraction of the stepper motor shaft 258 to the right in the drawings from the center neutral position in FIG. 8 produces motion of the pilot spool 240 to the right as illustrated in FIG. 11. Such motion of the pilot spool 240 applies pressurized fluid to the first chamber 234 and connects the second chamber 238 to the tank passage 52. With reference to FIG. 2, the double acting spring 47, that biases the opposite end of the control spool 206, also is compressed due to this rightward motion of the control spool, thus exerting a counterforce to the pressure in the first chamber 234. As with the leftward motion previously described, when this spring force counterbalances the force from the pressure in the first chamber 234, the control spool reaches an equilibrium position and stops moving in the desired position determined by the position of the pilot spool 240.

One skilled in the art will appreciate that the supply and return passages 208 and 52 can be reversed with corresponding alteration of the passages formed in the control spool 206, pilot piston 210, and pilot spool 240.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. In a valve assembly having body in which a control spool selectively controls flow of fluid between at least one workport and both a supply passage and a return passage, a pilot valve comprising:

a piston bore formed in the body;

a pilot piston connected to the control spool and slideably received in the piston bore, thereby defining a first chamber and a second chamber in the piston bore, wherein the pilot piston is tubular and extends around the control spool;

a pilot spool slidably received in the body and moveable into first and second positions with respect to the control spool, wherein in the first position the first chamber communicates with the supply passage but not with the tank passage and the second chamber communicates with the tank passage, and in the second position the second chamber communicates with the supply passage but not with the tank passage, wherein the pilot spool is slidably received within a bore in the control spool and wherein the pilot spool has passages therein which form the fluid paths between each of the first chamber and a second chamber and the supply passage and a return passage in selected positions of the pilot spool; and a linear actuator engaging the pilot spool to move the pilot spool with respect to the control spool.

2. In a valve assembly having a control spool which selectively controls flow of fluid between at least one workport and both a supply passage and a return passage, a pilot valve comprising:

a body with a bore into which the control spool extends, a first opening into the bore communicates with one of the supply passage and the return passage, and a second opening into the bore communicates with the other of the supply passage and the return passage;

a pilot piston connected to the control spool and slideably received in the bore thereby defining a first chamber and a second chamber in the bore, the pilot piston having a feeder aperture that communicates with the first opening in the body and with a first aperture in the control spool;

a pilot spool slidably received in a pilot bore in the control spool and having a first position which provides fluid paths between the first aperture and both the first chamber and a second chamber in the bore, a second position at which communication is provided between the first aperture and the first chamber and between the second aperture and the second chamber, and a third position at which communication is provided between the second aperture and the first chamber and between the first aperture and the second chamber; and a linear actuator operably coupled to move the pilot spool within the control spool.

3. The pilot valve as recited in claim 2 wherein the pilot piston has a tubular shape through which the control spool extends.

4. The pilot valve as recited in claim 2 further comprising a spring biasing the pilot spool with respect to the control spool.

5. The pilot valve as recited in claim 2 wherein the linear actuator is coupled to the pilot spool by a spring.

6. The pilot valve as recited in claim 2 wherein the pilot spool has a pair of grooves on an exterior surface through which fluid flows in selected positions of the pilot spool.

7. The pilot valve as recited in claim 2 wherein the pilot spool has a primary aperture and a plurality of exhaust apertures through which fluid flows to or from the second opening in the body in selected positions of the pilot spool.

8. The pilot valve as recited in claim 2 wherein the linear actuator is a stepper motor.

9. In a valve assembly having a control spool which selectively controls flow of fluid between at least one workport and both a supply passage and a return passage, a pilot valve comprising:

a body with a piston bore into which a section of the control spool extends, a first opening into the bore communicates with one of the supply passage and the return passage, and a second opening into the bore communicates with the other of the supply passage and the return passage;

a tubular pilot piston through which the control spool extends and is connected thereto, the pilot piston being slideably received in the piston bore thereby defining a first chamber and a second chamber in the piston bore, the pilot piston having a feeder aperture that communicates with the first opening in the body and with a first aperture in the control spool;

a pilot spool slidably received in a pilot bore in the control spool and having a first position which opens a first passage between the first aperture in the control spool and the first chamber in the piston bore and opens a second passage between the first aperture and the second chamber in the piston bore, a second position which opens the first passage and a third passage between the second chamber and the second opening in the piston bore, and a third position which opens the second passage and a fourth passage between the first chamber and the second opening; and a linear actuator operably coupled to move the pilot spool within the control spool.

10. The pilot valve as recited in claim 9 further comprising a spring that biases the pilot spool with respect to the control spool.

11. The pilot valve as recited in claim 9 wherein the linear actuator is coupled to the pilot spool by a spring.

12. The pilot valve as recited in claim 9 wherein the pilot spool has a longitudinal primary aperture from which a first exhaust aperture and a second exhaust aperture extend to an outer surface, wherein the primary aperture and the first and second exhaust apertures at least partially form the third and fourth passages.

13. The pilot valve as recited in claim 12 wherein the control spool has first cross aperture and a second cross aperture both extending between an exterior surface and the pilot bore, wherein the first cross aperture cooperates with the first exhaust aperture to form the fourth passage, and the second cross aperture cooperates with the second exhaust aperture to form the third passage.

14. The pilot valve as recited in claim 9 wherein the pilot spool has a first exterior groove and a second exterior groove, wherein the first and second exterior grooves at least partially form the first passage and the second passage.

15. The pilot valve as recited in claim 14 wherein the control spool has a second aperture and a third aperture both extending between an exterior surface and the pilot bore, wherein the second aperture cooperates with the first exterior groove to form the first passage, and the third aperture cooperates with the second exterior groove to form the second passage.

16. The pilot valve as recited in claim 14 wherein the pilot piston has a first interior groove which cooperates with the second aperture of the control spool to form the first passage, and has a second interior groove which cooperates with the third aperture of the control spool to form the second passage.

* * * * *